US011795739B2

(12) United States Patent
Heyduck et al.

(10) Patent No.: US 11,795,739 B2
(45) Date of Patent: Oct. 24, 2023

(54) VEHICLE DOOR HAVING AN EXTENDABLE DOOR HANDLE

(71) Applicant: DAIMLER AG, Stuttgart (DE)

(72) Inventors: Jan Heyduck, Sindelfingen (DE); Juergen Jooss, Böblingen (DE); Tobias Konrad, Böblingen (DE); Martin Lindmayer, Sulz (DE)

(73) Assignee: MERCEDES-BENZ GROUP AG, Stuttgart (DE)

( * ) Notice: Subject to any disclaimer, the term of this patent is extended or adjusted under 35 U.S.C. 154(b) by 344 days.

(21) Appl. No.: 17/415,817

(22) PCT Filed: Oct. 22, 2019

(86) PCT No.: PCT/EP2019/078699
§ 371 (c)(1),
(2) Date: Jun. 18, 2021

(87) PCT Pub. No.: WO2020/126161
PCT Pub. Date: Jun. 25, 2020

(65) Prior Publication Data

US 2022/0042355 A1 Feb. 10, 2022

(30) Foreign Application Priority Data

Dec. 19, 2018 (DE) ..... 10 2018 010 031.7

(51) Int. Cl.
*E05B 85/10* (2014.01)
*E05B 77/02* (2014.01)
*E05B 81/90* (2014.01)

(52) U.S. Cl.
CPC ..... *E05B 85/107* (2013.01); *E05B 77/02* (2013.01); *E05B 81/90* (2013.01)

(58) Field of Classification Search
CPC ..... E05B 85/107; E05B 85/103; E05B 77/02; E05B 77/12; E05B 81/90; E05B 81/20; E05B 81/64
(Continued)

(56) References Cited

U.S. PATENT DOCUMENTS 8,443,553 B1 * 5/2013 Polewarczyk ..... E05B 81/77 292/DIG. 31
8,701,353 B2 * 4/2014 Patel ..... E05B 85/103 292/201
(Continued)

FOREIGN PATENT DOCUMENTS

CA 2849759 A1 * 5/2013 ..... B64D 29/06
CN 104024664 A 9/2014
(Continued)

OTHER PUBLICATIONS

International Search Report dated Jan. 15, 2020 in related/corresponding International Application No. PCT/EP2019/078699.
(Continued)

*Primary Examiner* — Jerry E Redman
(74) *Attorney, Agent, or Firm* — PATENT PORTFOLIO BUILDERS PLLC

(57) ABSTRACT

A motor vehicle door has a shell and a door handle that can be moved laterally in relation to a vehicle longitudinal axis between a retracted and an extended position. In the retracted position the door handle is in a recess adjusted to the contour of the door handle, the recess being arranged in the shell of the vehicle door with a door handle surface substantially flush with the shell. In the extended position, the door handle is moved laterally outwards so that it is actuatable from outside for opening the vehicle door. In the extended position, the door handle is firstly in active connection with a switch, which is coupled to the electrical unlocking device of a door lock, and secondly is mechani-
(Continued)

Figure 1:
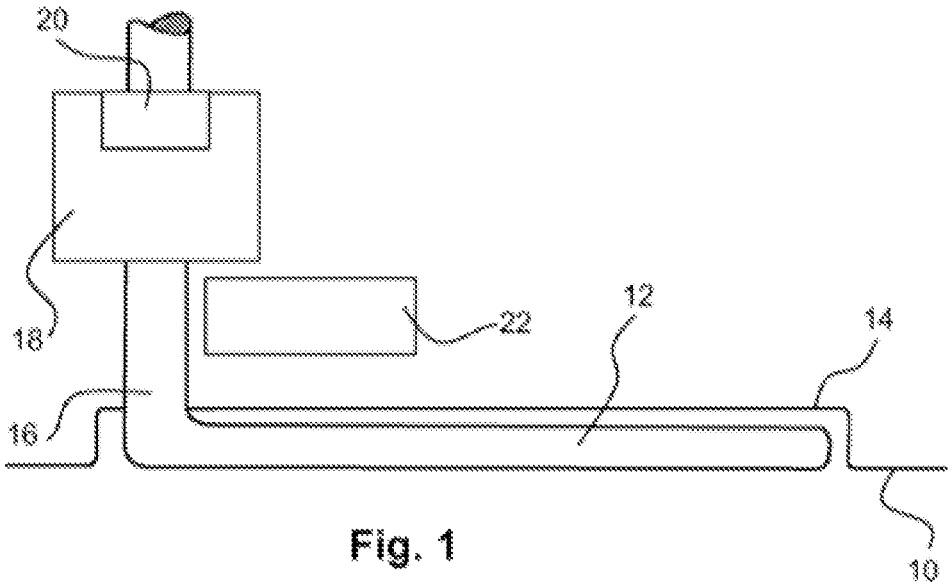

cally coupled to the door lock, such that an actuation of the door handle with a minimal actuation path effectuates the switch and an electrical unlocking device of the door lock and an actuation of the door handle with a greater actuation path effectuates a mechanical unlocking of the door lock.

8 Claims, 2 Drawing Sheets

(58) Field of Classification Search
USPC ..... 49/503
See application file for complete search history.

(56) References Cited

U.S. PATENT DOCUMENTS

| | | | | |
|---|---|---|---|---|
| 8,919,047 | B2 | 12/2014 | Johnsrud et al. | |
| 9,322,191 | B2 | 4/2016 | Müller et al. | |
| 10,167,656 | B2 * | 1/2019 | Park | E05B 85/107 |
| 10,563,437 | B2 * | 2/2020 | Bartels | B60Q 1/2669 |
| 10,590,677 | B2 | 3/2020 | Papanikolaou et al. | |
| 11,268,306 | B2 * | 3/2022 | Ishikawa | E05B 77/06 |
| 11,578,512 | B2 * | 2/2023 | Ge | E05B 85/16 |
| 2011/0148575 | A1 * | 6/2011 | Sobecki | E05B 5/006 292/336.3 |
| 2014/0232122 | A1 | 8/2014 | Schnetter et al. | |
| 2017/0370123 | A1 | 12/2017 | Papanikolaou et al. | |
| 2018/0112445 | A1 | 4/2018 | Phillips | |
| 2018/0274271 | A1 | 9/2018 | Och et al. | |
| 2019/0211592 | A1 * | 7/2019 | Bextermöller | E05B 81/78 |
| 2020/0347638 | A1 * | 11/2020 | Renner | E05B 5/003 |
| 2022/0042355 | A1 * | 2/2022 | Heyduck | E05B 77/12 |

FOREIGN PATENT DOCUMENTS

| | | | | | |
|---|---|---|---|---|---|
| CN | 107075884 | A | | 8/2017 | |
| CN | 108474221 | A | | 8/2018 | |
| CN | 109154171 | A | * | 1/2019 | E05B 5/107 |
| CN | 108541288 | B | * | 10/2020 | E05B 15/0046 |
| DE | 102010016869 | A1 | | 11/2011 | |
| DE | 102013215896 | A1 | | 2/2014 | |
| DE | 102013006826 | A1 | * | 10/2014 | E05B 77/06 |
| DE | 102015011468 | A1 | | 3/2017 | |
| DE | 202017103702 | U1 | | 7/2017 | |
| DE | 102016119832 | A1 | * | 4/2018 | E05B 77/06 |
| DE | 112016004844 | T5 | | 8/2018 | |
| WO | WO-2020141323 | A1 | * | 7/2020 | E05B 1/0092 |

OTHER PUBLICATIONS

Office Action dated Jul. 29, 2019 in related/corresponding DE Application No. 10 2018 010 031.7.

Written Opinion dated Jan. 15, 2020 in related/corresponding International Application No. PCT/EP2019/078699.

Office Action dated Feb. 16, 2022 in related/corresponding CN Application No. 201980084264.0.

* cited by examiner

VEHICLE DOOR HAVING AN EXTENDABLE DOOR HANDLE

BACKGROUND AND SUMMARY OF THE INVENTION

Exemplary embodiments of the invention relate to a vehicle door for a motor vehicle having a shell and a door handle that can be moved laterally in relation to a longitudinal axis of the vehicle between a retracted and an extended position, which door handle, in the state retracted into a recess adjusted to the contour of the door handle, is arranged in the shell of the vehicle door with a door handle outer surface substantially flush with the shell and, in the extended position, is moved laterally outwards so far that it can be actuated from outside for opening the vehicle door.

Such vehicle doors having flush door handles are known from DE 10 2013 215 896 A1 or DE 20 2017 103 702 U1, for example. Here, the door handles are driven electromotively, which has the disadvantage that an actuation is not possible in the event of electricity failure. Alternatively, when mechanically acting on a door lock, a certain force expenditure is necessary.

Exemplary embodiments of the invention are directed to opening such a vehicle in normal operation with low force expenditure yet also in the event of electricity failure when the on-board battery is empty due to certain circumstances or the current supply to the door lock is interrupted for other reasons.

According to the invention, the door handle in the extended position firstly being actively connected to a switch, which is coupled to the electrical unlocking mechanism of a door lock and secondly being mechanically coupled to the door lock, such that an actuation of the door handle with a minimal actuation path effectuates the switch and an electrical unlocking mechanism of the door lock and an actuation of the door handle with a greater actuation path effectuates a mechanical unlocking mechanism of the door lock.

As a result of the design according to the invention, firstly a countersunk door handle that is flush to the surface when the door is closed is provided which is produced cost-effectively with a valuable design and can be moved by a movement of it into the extended (usage) position and thus an ergonomic gripping chamber can be generated for actuating the door handle.

In normal operation, the vehicle door can be opened with minimal force. In the event of the electric system malfunctioning, be that no electrical energy being available or the electrical switch present in the door handle being defective, the vehicle door can be mechanically opened in emergency operation. In the retracted non-usage position, the door handle is in the recess or hollow on the door side, which excludes an erroneous actuation due to the tight fit, which must be avoided, in particular in the event of a side impact by a foreign impingement, for example triggered by foreign objects or barriers.

Preferably, the greater actuation path for the mechanical door unlocking device is at least five times as great as the actuation path for the electrical door unlocking device. Thus, when pulling on the door handle, the unlocking can be triggered.

According to an advantageous development of the invention, the door handle is coupled to an adjustment device in order to move this out of the retracted position into the extended position and vice versa. This preferably comprises a fixing unit, which fixes the door handle in the retracted position. This fixing is preferably switched together with the latching of the door lock, such that the door handle is always fixed in the countersunk position when the door lock is also latched.

According to an advantageous development of the invention, the adjustment device is coupled to a control unit, which comprises a signal input for a door handle release signal and, upon receipt of such a signal, moves the door handle out of the retracted position into the extended position. In this design, the extension of the door handle is carried out by the external signal, which records the approximation of a hand by actuating a switch, a remote operation, or the detection of a key located in the vicinity provided with an RFID transponder or with the aid of a capacitive and/or optical approximation sensor. Some or all of these methods can preferably also be applied in parallel.

According to an advantageous development of the invention, the door handle is formed substantially L-shaped, which can be rotated around a lateral rotational axis. Such a design can be actuated simply and intuitively because vehicle users are used to this with room doors.

Preferably, the recess is formed in such a way that it surrounds the contour of the gripping element with an air gap of c. 1 mm [R1]. By means of this narrow, tight-fit surrounding of the door handle, an erroneous operation can be extensively excluded.

According to an advantageous development of the invention, the switch is coupled to a motoric door drive device, which switch motorically opens the vehicle door after unlocking the door lock. A motoric narrow opening of the door can facilitate, above all, the manual door opening when the door seals are adhered by frost or dirt.

According to an advantageous development of the invention, the adjustment device comprises a signal input for a crash signal and is formed to actuate the adjustment device upon obtaining a crash signal, to move the adjustment device into the retracted position and to out the fixing unit into the fixed state. Thus, in the event of an accident, the door handle is prevented from emerging and being damaged or causing damage, above all injury to people.

According to an advantageous development of this design, the adjustment device is formed to put the fixing unit in an unfixed state at the end of a predetermined period of time of preferably 5 to 10 seconds after obtaining a crash signal and to actuate the adjustment device to move it into the extended position so that the door handle is accessible from the outside after an accident so that helpers can open the vehicle door.

The invention further comprises a motor vehicle having at least one vehicle door according to one of the designs mentioned above.

Further advantages, features and details emerge from the description below in which—optionally with reference to the drawings—at least one exemplary embodiment is described in detail. The same, similar and/or functionally identical parts are provided with the same reference numbers.

BRIEF DESCRIPTION OF THE DRAWING FIGURES

Figure 2:
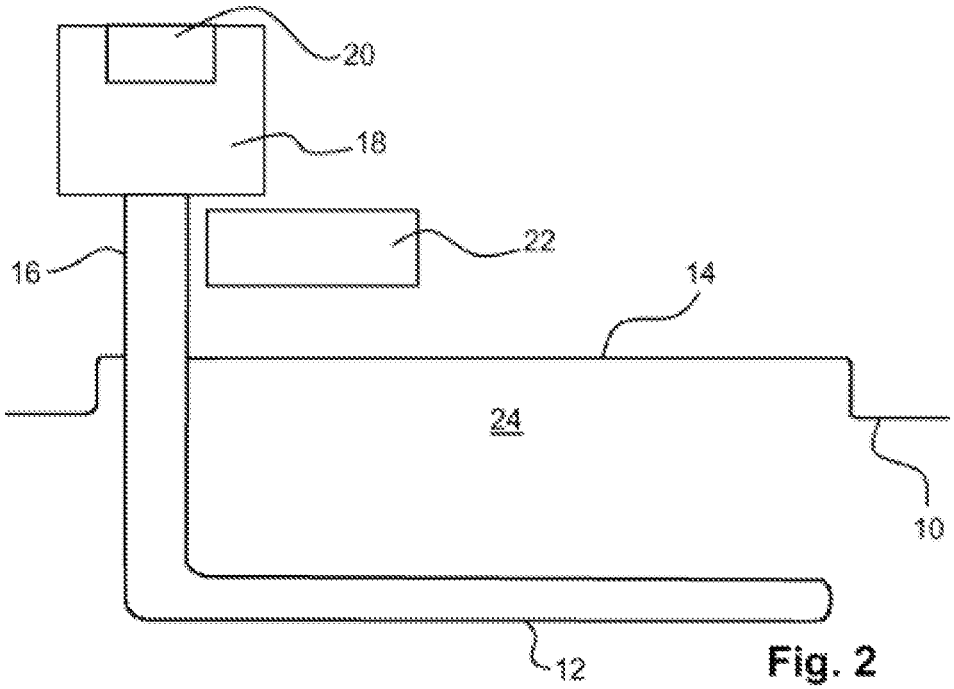
Figure 3:
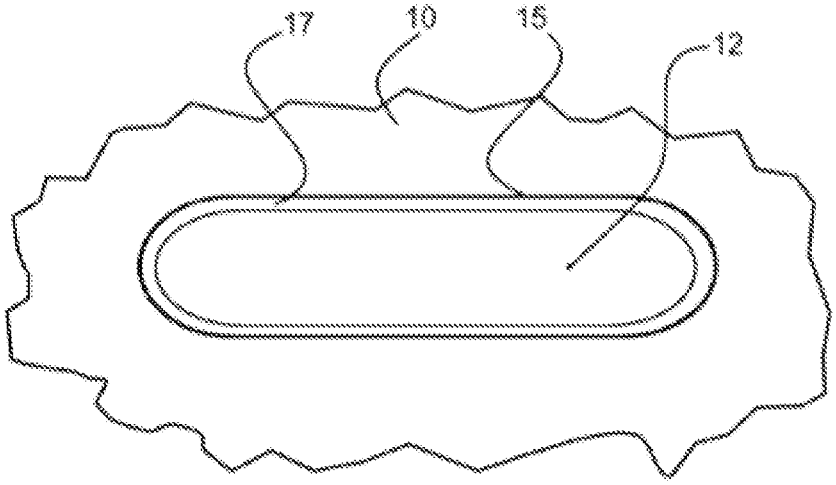
Figure 4:
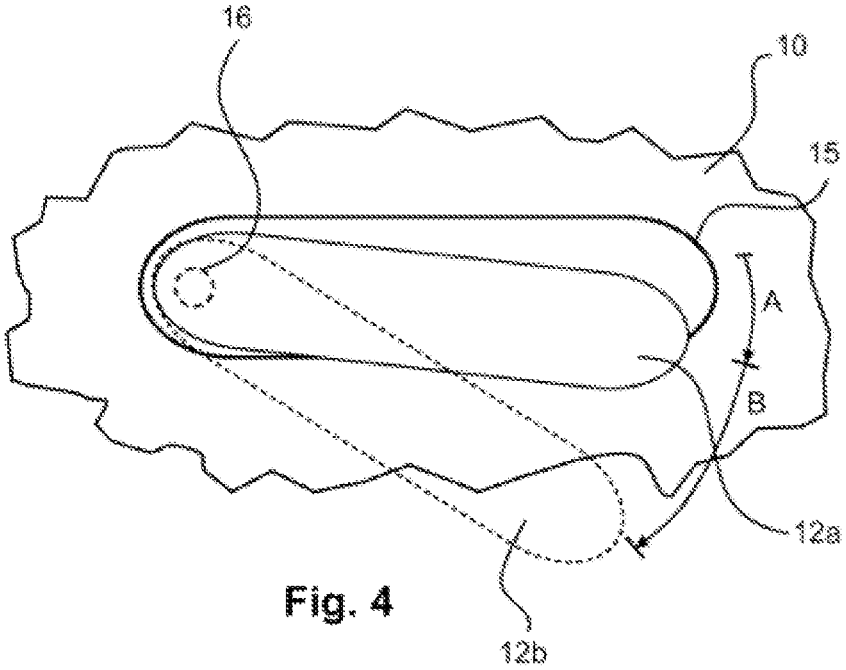

Here are shown:

FIG. 1: a schematic partial sectional depiction of a vehicle door on a horizontal sectional plane with a door handle in a retracted position;

FIG. 2: a schematic partial sectional depiction of the vehicle door from FIG. 1 with the door handle in an extended position, FIG. 3: a schematic top view of a section of the vehicle door with the door handle in the retracted or countersunk position, and FIG. 4: a schematic top view of a section of the vehicle door with the door handle in an extended and two actuated positions.

DETAILED DESCRIPTION

FIG. 1 illustrates a schematic partial sectional depiction of a vehicle door 10 on a horizontal plane with a door handle 12 in a retracted position, in which it lies in a recess or hollow 14, which is molded into the shell of the vehicle door 10. The outside of the door handle 12 is molded in such a way that, in the retracted position, it is arranged flushly with the shell of the vehicle door 10, wherein only a narrow gap 17 of c. 1 mm remains between the door handle 12 and an edge 15 of the indentation or hollow 14.

The door handle 12 has a substantial L-shape with a shaft 16 extending laterally inwards, the shaft being coupled to a door handle adjustment device 18, which can shift the shaft 16 and thus the L-shaped door handle 12 in the lateral direction between the retracted position depicted in FIG. 1 and an extended position shown in FIG. 2. The door handle adjustment device 18 further preferably comprises a fixing device 20, which is formed to fix the shaft 16 in the retracted position and thus to prevent the door handle 12 being able to be moved out of the retracted position, in particular as a result of forceful loads.

A switch 22 is on the shaft 16, which switch can be formed as a button, microswitch, sensory key, pivot point, push-pull button, or sensor and records a rotational movement of the shaft 16.

When the door handle adjustment device 18 moves the shaft 16 and thus the door handle 12 out of the retracted position shown in FIG. 1 into the extended position shown in FIG. 2, a gripping chamber 24 of sufficient size in order to be able to ergonomically favorably grip the door handle 12 is formed between the hollow 14 and the door handle 12.

If the door handle 12 is in the extended position shown in FIG. 2, this can—as depicted in FIG. 4—be pushed downwards rotatably around the rotational axis formed by the shaft 16, similar to a room door handle. If, after rotation in a direction labeled with A, the door handle has reached the position 12*a* characterized by drawn through lines, the switch 22 triggers and emits a signal to a control unit, which unlocks a door lock. In addition, a motoric door drive device can be controlled, which opens the vehicle door, for example, a narrow amount.

If the door handle 12 is moved further by the arcuate distance B (FIG. 4), then a mechanical coupling, not depicted, to the door lock becomes effective, whereby the door lock is mechanically unlocked.

Although the invention has been illustrated and explained in more detail by preferred exemplary embodiments, the invention is not limited by the disclosed examples, and other variations can be derived from this by the person skilled in the art without leaving the protective scope of the invention. It is thus clear that there is a plurality of variation possibilities. It is also clear that embodiments mentioned by way of example really only constitute examples which cannot be interpreted in any other way as limiting the protective scope, for example, the application possibilities or the configuration of the invention. Instead, the description above and the description of the figures put the person skilled in the art in the position to concretely implement the exemplary embodiments, wherein the person skilled in the art, with the knowledge of the inventive thought disclosed, can undertake various changes, for example in terms of the function or the arrangement of individual elements mentioned in an exemplary embodiment, without leaving the scope of protection, which is defined by the claims and their legal equivalents, such as extensive explanations in the description, for example.

The invention claimed is:

1. A vehicle door for a motor vehicle, the vehicle door comprising:

a shell;

a door handle that is moveable laterally in relation to a vehicle longitudinal axis between a retracted and an extended position; and an adjustment device coupled to the door handle in order to move the door handle out of the retracted position into the extended position and vice-versa, wherein the adjustment device comprises a fixing unit that fixes the door handle in the retracted position, wherein, in the retracted position the door handle is in a recess conforming to a contour of the door handle, wherein the recess is in the shell of the vehicle door, wherein in the retracted position a door handle surface of the door handle is flush with the shell, wherein in the extended position, the door handle is moved laterally outwards so that the door handle is actuatable from outside for opening the vehicle door, and wherein, in the extended position, the door handle is first in active connection with a switch, which is coupled to an electrical unlocking device of a door lock of the vehicle door, and second is mechanically coupled to the door lock such that an actuation of the door handle with an initial actuation path actuates the switch and an electrical unlocking device of the door lock, and an actuation of the door handle with a greater actuation path than the initial actuation path actuates a mechanical unlocking of the door lock.

2. The vehicle door of claim 1, wherein the adjustment device is coupled to a control unit, which comprises a signal input for a door handle release signal and, upon receipt of such a signal, the adjustment device is configured to move the door handle out of the retracted position and into the extended position.

3. The vehicle door of claim 1, wherein the door handle is L-shaped and is rotatable around a lateral rotational axis.

4. A vehicle door for a motor vehicle, the vehicle door comprising:

a shell;

a door handle that is moveable laterally in relation to a vehicle longitudinal axis between a retracted and an extended position; and an adjustment device coupled to the door handle in order to move the door handle out of the retracted position into the extended position and vice-versa, wherein the adjustment device comprises a fixing unit that fixes the door handle in the retracted position, wherein, in the retracted position the door handle is in a recess conforming to a contour of the door handle, wherein the recess is in the shell of the vehicle door, wherein in the retracted position a door handle surface of the door handle is flush with the shell, wherein in the extended position, the door handle is moved laterally outwards so that the door handle is actuatable from outside for opening the vehicle door, and wherein, in the extended position, the door handle is first in active connection with a switch, which is coupled to an electrical unlocking device of a door lock of the vehicle door, and second is mechanically coupled to the door lock such that an actuation of the door handle with an initial actuation path actuates the switch and an electrical unlocking device of the door lock, and an actuation of the door handle with a greater actuation path than the initial actuation path actuates a mechanical unlocking of the door lock, wherein the switch is coupled to a motoric door drive device, wherein the switch is configured to motorically open the vehicle door after unlocking the door lock, and wherein the adjustment device comprises a signal input for a crash signal and is configured to actuate the adjustment device upon obtaining the crash signal, to move the door handle into the retracted position and to put the fixing unit in a fixed state.

5. The vehicle door of claim 4, wherein the adjustment device is configured to put the fixing unit in an unfixed state after a predetermined period of time of 5 to 10 seconds after obtaining the crash signal and to actuate the adjustment device to move the door handle into the extended position.

6. A motor vehicle, comprising:

a vehicle door, which comprises a shell;

a door handle that is moveable laterally in relation to a vehicle longitudinal axis between a retracted and an extended position; and an adjustment device coupled to the door handle in order to move the door handle out of the retracted position into the extended position and vice-versa, wherein the adjustment device comprises a fixing unit that fixes the door handle in the retracted position, wherein, in the retracted position the door handle is in a recess conforming to a contour of the door handle, wherein the recess is in the shell of the vehicle door, wherein in the retracted position a door handle surface of the door handle is flush with the shell, wherein in the extended position, the door handle is moved laterally outwards so that the door handle is actuatable from outside for opening the vehicle door, and wherein, in the extended position, the door handle is first in active connection with a switch, which is coupled to an electrical unlocking device of a door lock of the vehicle door, and second is mechanically coupled to the door lock such that an actuation of the door handle with an initial actuation path actuates the switch and an electrical unlocking device of the door lock, and an actuation of the door handle with a greater actuation path than the initial actuation path actuates a mechanical unlocking of the door lock.

7. The motor vehicle of claim 6, wherein the switch is coupled to a motoric door drive device, wherein the switch is configured to motorically open the vehicle door after unlocking the door lock, and the adjustment device comprises a signal input for a crash signal and is configured to actuate the adjustment device upon obtaining the crash signal, to move the door handle into the retracted position and to put the fixing unit in a fixed state.

8. The motor vehicle door of claim 7, wherein the adjustment device is configured to put the fixing unit in an unfixed state after a predetermined period of time of 5 to 10 seconds after obtaining the crash signal and to actuate the adjustment device to move the door handle into the extended position.

* * * * *